US007398589B2

(12) United States Patent
Younger et al.

(10) Patent No.: US 7,398,589 B2
(45) Date of Patent: Jul. 15, 2008

(54) METHOD FOR MANUFACTURING A TRANSFORMER WINDING

(75) Inventors: Harold R. Younger, Halifax, VA (US); Egil Stryken, Solbergelva (NO); John Wallumrod, Hof (NO)

(73) Assignee: ABB Technology AG, Zurich (CH)

( * ) Notice: Subject to any disclaimer, the term of this patent is extended or adjusted under 35 U.S.C. 154(b) by 105 days.

(21) Appl. No.: 10/608,353

(22) Filed: Jun. 27, 2003

(65) Prior Publication Data

US 2004/0261252 A1 Dec. 30, 2004

(51) Int. Cl.
*H01F 7/06* (2006.01)

(52) U.S. Cl. ..... 29/602.1; 29/605; 29/606; 29/608; 336/200

(58) Field of Classification Search ..... 29/602.1, 29/605–609, 593–595; 336/92, 222, 226, 336/229, 65, 96, 110, 178, 200, 205, 232–234; 72/148, 224; 242/434.5, 449.1; 427/121, 427/197; 428/211, 195.1
See application file for complete search history.

(56) References Cited

U.S. PATENT DOCUMENTS

| | | | | | |
|---|---|---|---|---|---|
| 3,675,174 | A | | 7/1972 | Horbach | 335/299 |
| 3,774,298 | A | * | 11/1973 | Eley | 29/605 |
| 3,904,785 | A | | 9/1975 | Baumann | 427/120 |
| 4,051,809 | A | * | 10/1977 | Zickar et al. | 118/630 |
| 4,204,087 | A | * | 5/1980 | Lin et al. | 174/120 SR |
| 4,554,730 | A | * | 11/1985 | Westervelt et al. | 29/605 |
| 4,741,947 | A | * | 5/1988 | Pataki | 428/211.1 |
| 5,194,181 | A | | 3/1993 | Reitz | 252/500 |
| 5,357,015 | A | | 10/1994 | Haruvy et al. | 528/10 |
| 5,367,760 | A | * | 11/1994 | Terlop et al. | 29/605 |
| 5,474,799 | A | | 12/1995 | Thigpen et al. | 427/104 |
| 5,589,129 | A | | 12/1996 | Kato et al. | 264/437 |
| 5,656,231 | A | | 8/1997 | Blackmore | 264/408 |
| 5,685,910 | A | | 11/1997 | Thigpen et al. | 118/666 |
| 5,710,535 | A | | 1/1998 | Goloff | 336/192 |
| 5,861,791 | A | | 1/1999 | Schneider | 336/205 |
| 6,157,012 | A | | 12/2000 | Tanaka et al. | 219/633 |
| 6,157,284 | A | | 12/2000 | Kanazawa | 336/198 |
| 6,160,464 | A | | 12/2000 | Clarke et al. | 336/60 |
| 6,216,513 | B1 | | 4/2001 | Nakamura et al. | 72/148 |
| 6,221,297 | B1 | | 4/2001 | Lanoue et al. | 264/219 |
| 6,223,421 | B1 | | 5/2001 | Lanoue et al. | 29/605 |
| 6,248,279 | B1 | | 6/2001 | Walsh | 264/254 |
| 6,256,865 | B1 | | 7/2001 | Larranaga et al. | 29/605 |
| 6,359,062 | B1 | | 3/2002 | Mallen | 525/58 |
| 6,368,530 | B1 | | 4/2002 | Adubato et al. | 264/154 |
| 6,445,269 | B1 | | 9/2002 | Sylvain et al. | 336/84 |
| 6,624,734 | B2 | * | 9/2003 | Lanoue et al. | 336/90 |
| 6,663,039 | B2 | * | 12/2003 | Hoffmann et al. | 242/434.5 |
| 2001/0005934 | A1 | | 7/2001 | Nakamura et al. | 29/605 |
| 2004/0003492 | A1 | * | 1/2004 | Wu | 29/602.1 |
| 2004/0257188 | A1 | * | 12/2004 | Younger et al. | 336/180 |

* cited by examiner

*Primary Examiner*—Minh Trinh
(74) *Attorney, Agent, or Firm*—Paul R. Katterle; Woodcock Washburn LLP

(57) ABSTRACT

A preferred method for manufacturing a transformer winding includes winding an electrical conductor into a first plurality of turns, placing an electrically insulating material having adhesive thereon over the first plurality of turns, and winding the electrical conductor into a second plurality of turns over the electrically insulating material. The preferred method also includes melting and curing the adhesive by energizing the electrical conductor so that a current greater than a rated current of the transformer winding flows through the electrical conductor.

18 Claims, 5 Drawing Sheets

METHOD FOR MANUFACTURING A TRANSFORMER WINDING

FIELD OF THE INVENTION

The present invention relates generally to transformers used for voltage transformation. More particularly, the invention relates to a method for manufacturing a transformer winding.

BACKGROUND OF THE INVENTION

Transformer windings are typically formed by winding an electrical conductor, such as copper or aluminum wire, on a continuous basis. The electrical conductor can be wound around a mandrel, or a directly onto a winding leg of the transformer. The electrical conductor is wound into a plurality of turns in side by side relationship to form a first layer of turns. A first layer of insulating material is subsequently placed around the first layer of turns. The electrical conductor is wound into a second plurality of turns over the first layer of insulating material, thereby forming a second layer of turns.

A second layer of insulating material is subsequently placed over the second layer of turns. The electrical conductor is then wound into a third plurality of turns over the second layer of insulation, thereby forming a third layer or turns. The above procedure can be repeated until a predetermined number of turn layers have been formed.

Heat-curable epoxy diamond pattern coated kraft paper (commonly referred to as "DPP paper") is commonly used as the insulating material in transformer windings. A transformer winding comprising DPP paper is typically heated after being wound in the above-described manner. The heating is necessary to melt and cure the epoxy adhesive on the DPP paper and thereby bond the DPP paper to the adjacent layer or layers of the electrical conductor. The transformer winding can be heated by placing the transformer winding in a hot-air convection oven (or other suitable heating device) for a predetermined period of time.

Transferring the transformer winding to a hot-air convection, and the subsequent heating process can increase the cycle time associated with the manufacture of the transformer winding. Moreover, the energy requirements of the hot-air convection oven can increase the overall manufacturing cost of the transformer winding. Also, it can be difficult to achieve uniform heating (and curing of the adhesive) throughout the transformer winding using a hot-air convection oven. Hence, adequate bonding between specific layers of the insulating material and the electrical conductor can be difficult to obtain (particularly between the innermost layers of the insulating material and the electrical conductor).

SUMMARY OF THE INVENTION

A preferred method for manufacturing a transformer winding comprises winding an electrical conductor into a first plurality of turns, placing an electrically insulating material having adhesive thereon over the first plurality of turns, and winding the electrical conductor into a second plurality of turns over the electrically insulating material. The preferred method also comprises melting and curing the adhesive by energizing the electrical conductor so that a current greater than a rated current of the transformer winding flows through the electrical conductor.

A preferred manufacturing method for a transformer winding comprising a first and a second layer of turns of an electrical conductor, and an electrically insulating material positioned between the first and second layers of turns and having adhesive on at least one side thereof comprises electrically coupling the electrical conductor to a power source and energizing the electrical conductor using the power source so that a current flows through the electrical conductor and heats the electrical conductor thereby causing the adhesive to at least one of melt and cure.

A preferred method for curing adhesive on an insulating material in a transformer winding comprises causing a current greater than a rated current of the transformer winding to pass through the transformer winding to heat the transformer winding to a temperature within a range of temperatures suitable for curing the adhesive, and adjusting the current greater than a rated current of the transformer winding to maintain the temperature of the transformer winding within the range of temperatures suitable for curing the adhesive for a predetermined period.

BRIEF DESCRIPTION OF THE DRAWINGS

The foregoing summary, as well as the following detailed description of a preferred method, is better understood when read in conjunction with the appended drawings. For the purpose of illustrating the invention, the drawings show an embodiment that is presently preferred. The invention is not limited, however, to the specific instrumentalities disclosed in the drawings. In the drawings.

DESCRIPTION OF PREFERRED METHODS

A preferred method for manufacturing a transformer winding is described herein. The preferred method is described in connection with a cylindrical transformer winding. The preferred method can also be applied to windings formed in other shapes, such as round, rectangular with curved sides, oval, etc.

Figure 1:
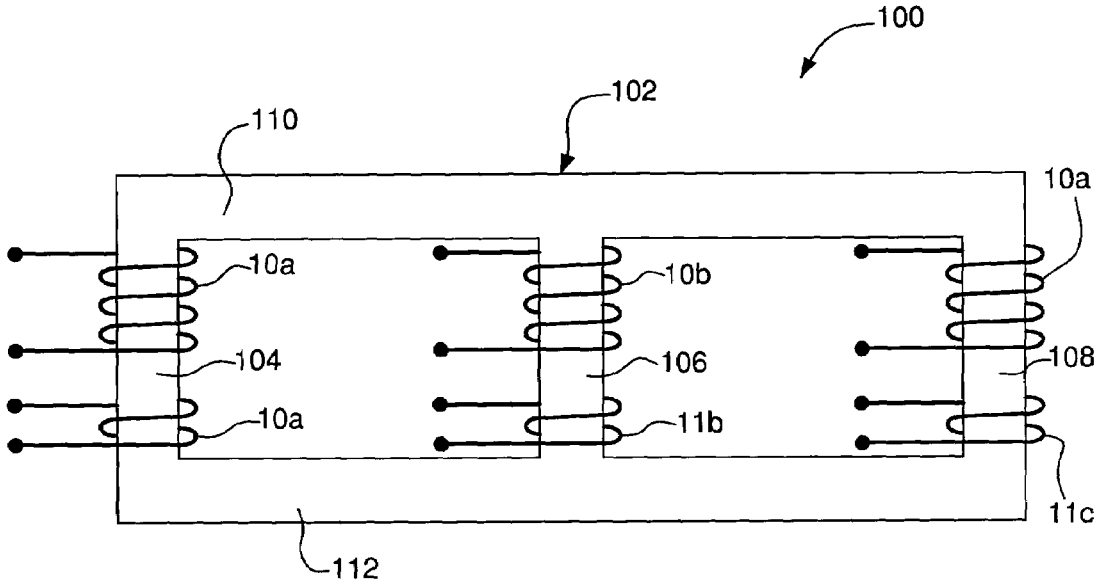
FIG. 1 is a diagrammatic side view of a transformer having primary and secondary windings manufactured in accordance with a preferred method for manufacturing a transformer winding.

The preferred method can be used to manufacture the transformer windings of a three-phase transformer 100 depicted in FIG. 1. The transformer 100 comprises a conventional laminated core 102. The core 102 is formed from a suitable magnetic material such as textured silicon steel or an amorphous alloy. The core 102 comprises a first winding leg 104, a second winding leg 106, and a third winding leg 108. The core 102 also comprises an upper yoke 110 and a lower yoke 112. Opposing ends of each of the first, second, and third winding legs 104, 106, 108 are fixedly coupled to the upper and lower yokes 110, 112 using, for example, a suitable adhesive.

Primary windings 10*a*, 10*b*, 10*c* are positioned around the respective first, second, and third winding legs 104, 106, 108. Secondary windings 11*a*, 11*b*, 11*c* are likewise positioned around the respective first, second, and third winding legs

104, 106, 108. The primary windings 10*a*, 10*b*, 10*c* are substantially identical. The secondary windings 11*a*, 11*b*, 11*c* are also substantially identical.

The primary windings 10*a*, 10*b*, 10*c* can be electrically connected in a "Delta" configuration, as is commonly known among those skilled in the art of transformer design and manufacture. The secondary windings 11*a*, 11*b*, 11*c* can be electrically connected in a "Delta" or a "Wye" configuration, depending on the voltage requirements of the transformer 100. (The electrical connections between the primary windings 10*a*, 10*b*, 10*c* and the secondary windings 11*a*, 11*b*, 11*c* are not shown in FIG. 1, for clarity.)

The primary windings 10*a*, 10*b*, 10*c* can be electrically coupled to a three-phase, alternating current (AC) power source (not shown) when the transformer 100 is in use. The secondary windings 11*a*, 11*b*, 11*c* can be electrically coupled to a load (also not shown). The primary windings 10*a*, 10*b*, 10*c* are inductively coupled to the secondary windings 10*a*, 10*b*, 10*c* via the core 102 when the primary windings 10*a*, 10*b*, 10*c* are energized by the load. More particularly, the AC voltage across the primary windings 10*a*, 10*b*, 10*c* sets up an alternating magnetic flux in the core 102. The magnetic flux induces an AC voltage across the secondary windings 11*a*, 11*b*, 11*c* (and the load connected thereto).

Descriptions of additional structural elements and functional details of the transformer 100 are not necessary to an understanding of the present invention, and therefore are not presented herein. Moreover, the above description of the transformer 100 is presented for exemplary purposes only. The preferred method can be performed on the windings of virtually any type of transformer, including single-phase transformers and transformers having concentric windings.

Figure 2:
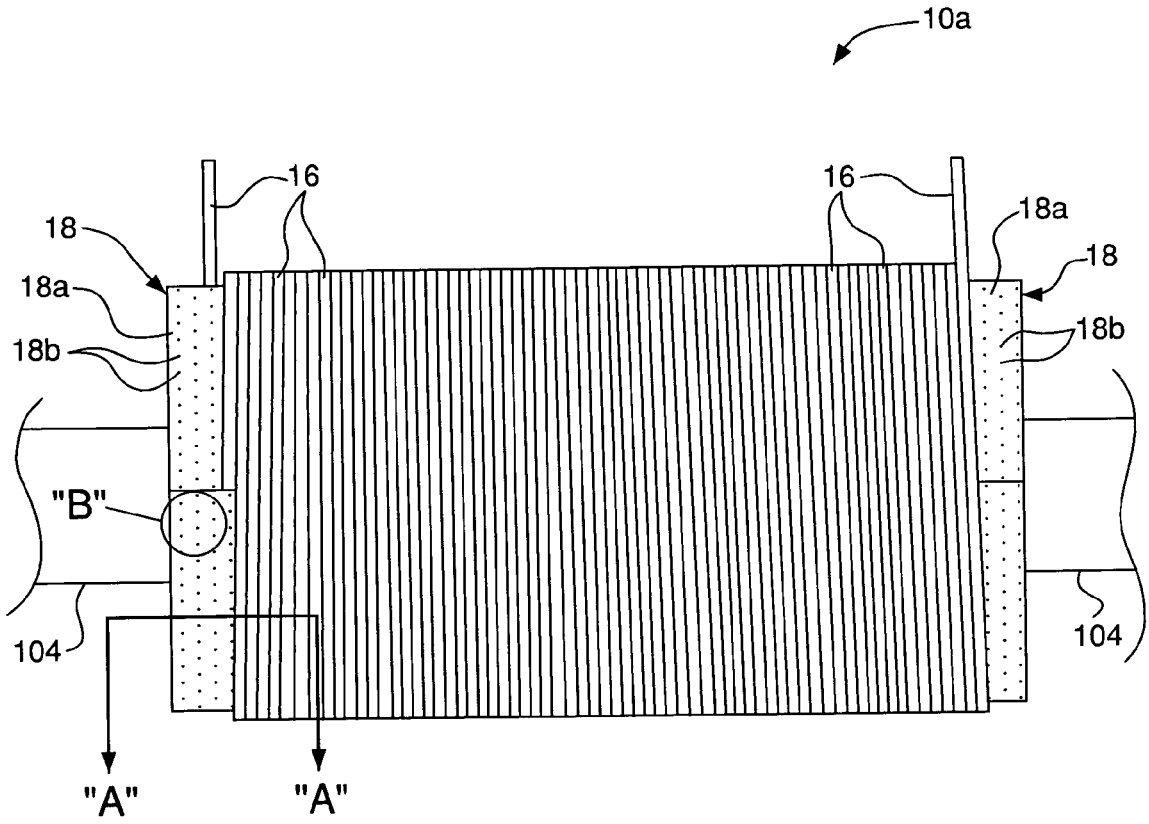
FIG. 2 is a diagrammatic side view of a primary winding and a winding leg of the transformer shown in FIG. 1.

The primary winding 10*a* comprises an electrical conductor 16 wound around the first winding leg 104 on a continuous basis (see FIG. 2). The electrical conductor 16 can be, for example, rectangular, round, or flattened-round aluminum or copper wire. The primary winding 10*a* also comprises face-width sheet layer insulation. More particularly, the primary winding 10*a* comprises sheets of insulation 18 (see FIGS. 2-4). The sheets of insulation 18 can be formed, for example, from heat-curable epoxy diamond pattern coated kraft paper (commonly referred to as "DPP paper").

Figure 4:
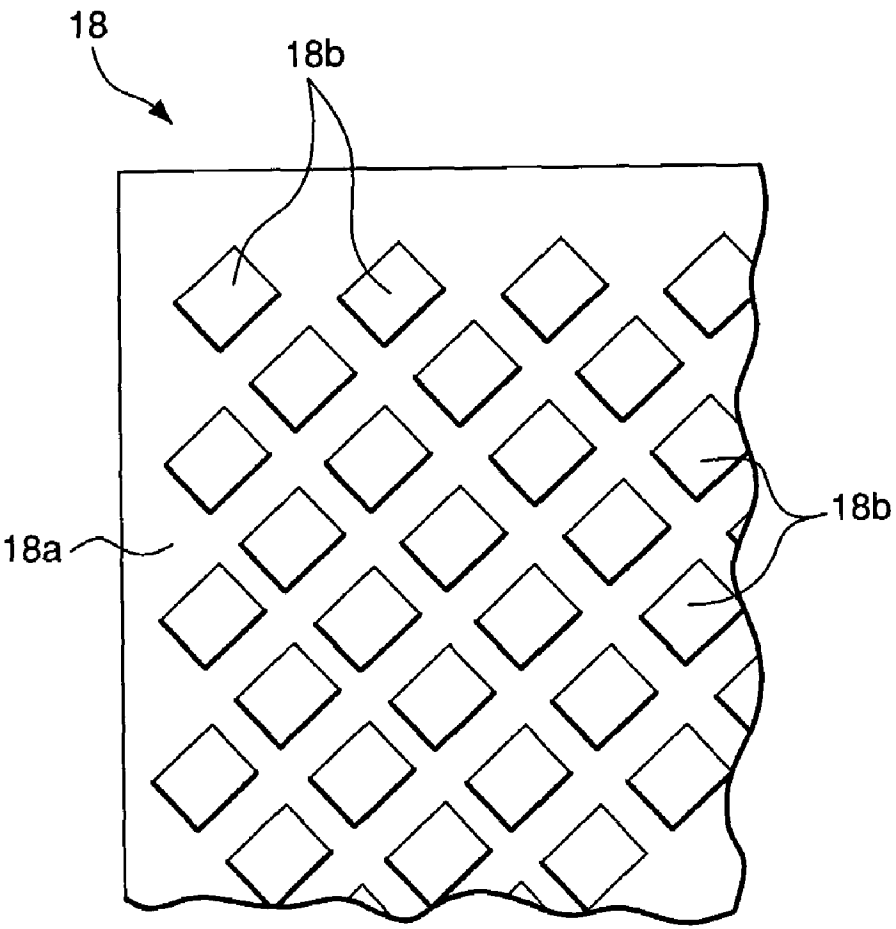
FIG. 4 is a magnified view of the area designated "B" in FIG. 2, showing details of an insulation sheet of the transformer shown in FIGS. 1-3.

Each insulating sheet 18 comprises a base paper 18*a* (see FIG. 4). Each insulating sheet 18 also comprises a plurality of relatively small diamond-shaped areas, or dots, of "B" stage epoxy adhesive 18*b* deposited on the base paper 18*a* as shown in FIG. 4. The adhesive 18*b* is located on both sides of the base paper 18*a*. The preferred method can also be practiced using insulating sheets having adhesive deposited on only one side of the base paper thereof. Moreover, the preferred method can be practiced using other types of insulation such as heat-curable epoxy fully coated kraft paper.

The primary winding 10*a* comprises overlapping layers of turns of the electrical conductor 16. A respective one of the sheets of insulation 18 is positioned between each of the overlapping layers of turns (see FIG. 3). The turns in each layer advance progressively across the width of the primary winding 10*a*. In other words, each overlapping layer of the primary winding 10*a* is formed by winding the electrical conductor 16 in a plurality of turns arranged in a side by side relationship across the width of the primary winding 10*a*.

The primary winding 10*a* is formed by placing one of the sheets of insulation 18 on an outer surface of the first winding leg 104 so that the sheet of insulation 18 covers a portion of the outer surface.

A first layer of turns 20 is subsequently wound onto the first winding leg 104. More particularly, the electrical conductor 16 is wound around the winding leg 104 and over the sheet of insulation 18, until a predetermined number of adjacent (side by side) turns have been formed. The winding operation can be performed manually, or using a conventional automated winding machine such as a model AM 3175 layer winding machine available from BR Technologies GmbH.

The second layer of turns 22 is formed after the first layer of turns 20 has been formed in the above-described manner. In particular, another of the sheets of insulation 18 is placed over the first layer of turns 20 so that an edge of the sheet of insulation 18 extends across the first layer of turns 20 (see FIG. 2). The sheet of insulation 18 can be cut so that opposing ends of the sheet of insulation 18 meet as shown in FIG. 2.

The electrical conductor 16 is subsequently wound over the first layer of turns 20 and the overlying sheet of insulation 18 to form the second layer of turns 22, in the manner described above in relation to the first layer of turns 20 (see FIG. 3). In other words, the second layer of turns 22 is formed by winding the electrical conductor 16 into a series of adjacent turns progressing back across the first layer of turns 20, until a predetermined turns count is reached.

Figure 3:
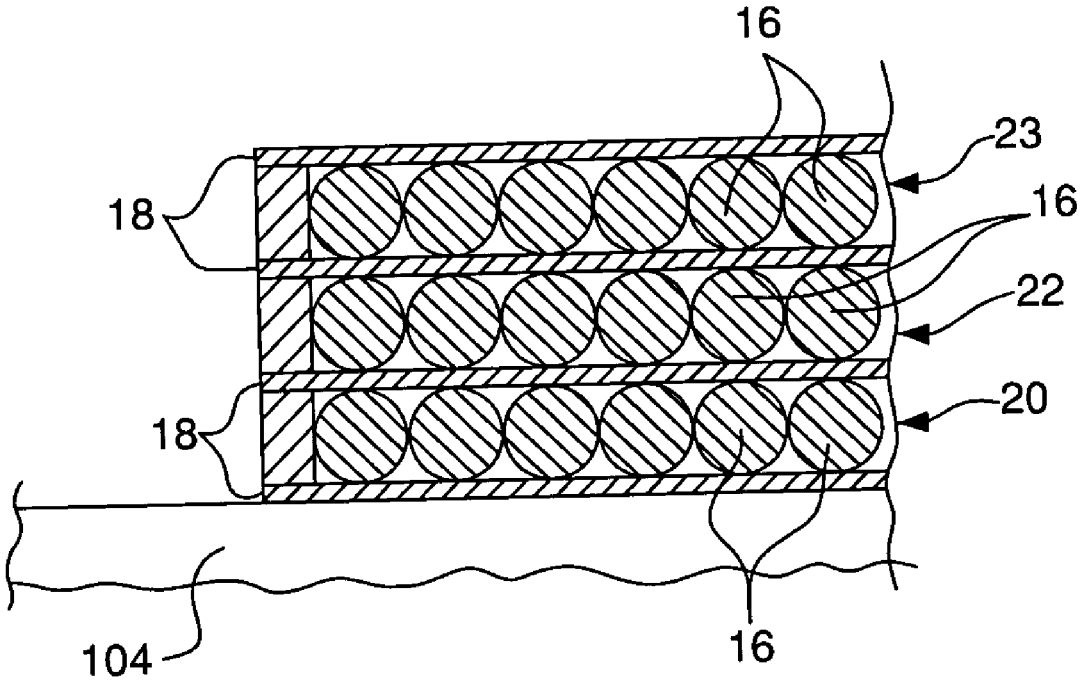
FIG. 3 is a magnified cross-sectional view of the primary winding and the winding leg shown in FIGS. 1 and 2, taken through the line "A-A" of FIG. 2.

The above procedures can be repeated until a desired number of turn layers have been formed in the primary winding 10*a* (only three of the turn layers are depicted in FIG. 3, for clarity).

It should be noted that a continuous strip of insulating material (not shown) can be used in lieu of the sheets of insulation 18. In particular, the continuous strip of insulating material can be continuously wound ahead of the electrical conductor 16 to provide substantially the same insulating properties as the sheets of insulation 18. The insulating strip can be positioned around a particular layer of the electrical conductor 16, and then cut to an appropriate length at the end of the layer using conventional techniques commonly known to those skilled in the art of transformer design and manufacture.

Moreover, the primary winding 10*a* can be wound on a mandrel and subsequently installed on the first winding leg 104, in lieu of winding the primary winding 10*a* directly onto the first winding leg 104.

The secondary winding 11*a* can subsequently be wound on the first winding leg 104 in the manner described above in connection with the primary winding 10*a*. The number of turns of the electrical conductor 16 in each layer of the primary and secondary windings 10*a*, 11*a* differs. The primary and secondary windings 10*a*, 11*a* are otherwise substantially identical.

The primary windings 10*b*, 10*c* and the secondary windings 11*b*, 11*c* can be wound in the above-described manner on a simultaneous or sequential basis with the primary and secondary winding 10*a*, 11*a*.

The upper yoke 100 can be secured to the first, second, and third winding legs 104, 106, 108 after the primary windings 10*a*, 10*b*, 10*c* and the secondary windings 11*a*, 11*b*, 11*c* have been wound.

Figure 5:
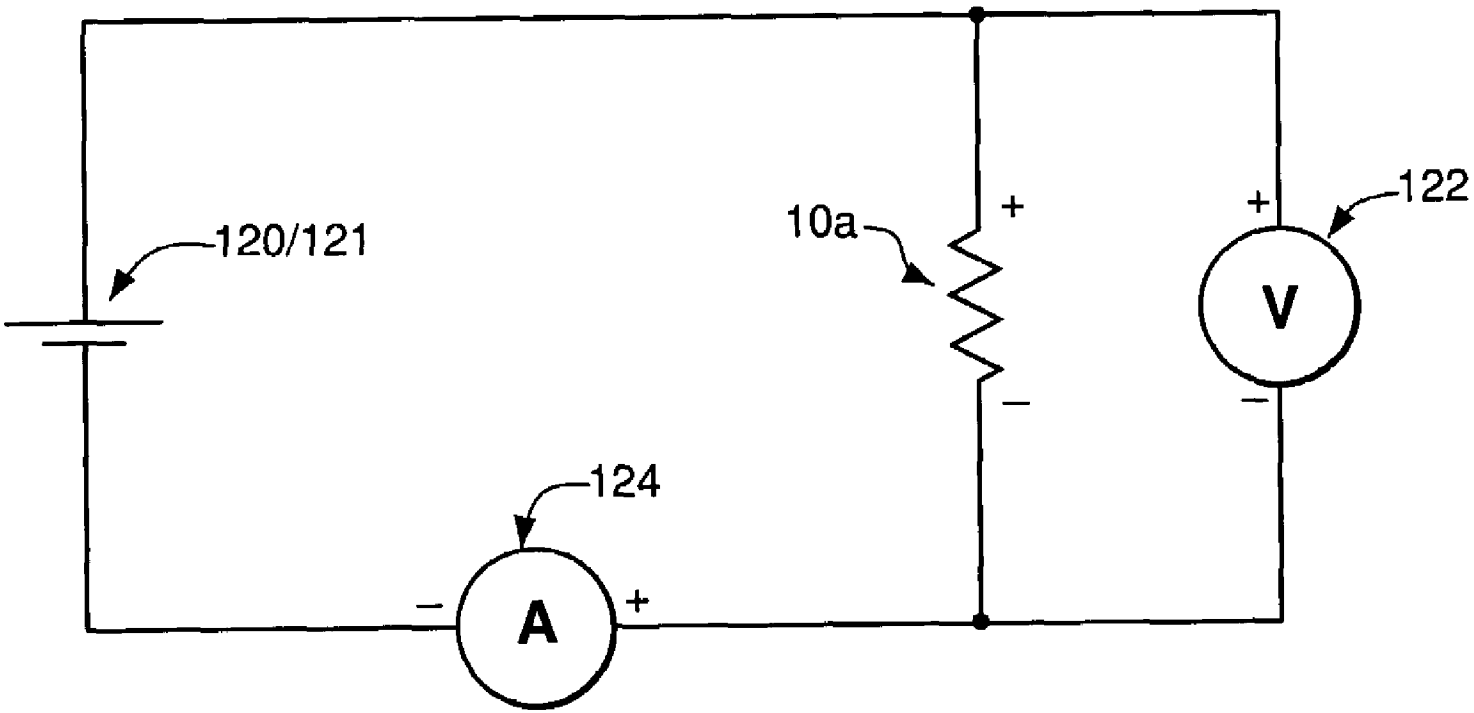
FIG. 5 is a schematic illustration of the primary winding shown in FIGS. 1-4 electrically coupled to a direct-current (DC) power supply, a variable power regulator, a voltmeter, and an ammeter.

The adhesive on the sheets of insulation 18 of the primary winding 10*a* can subsequently be melted and cured as follows. Opposing ends of the electrical conductor 16 of the primary winding 10*a* can be electrically coupled to a conventional DC power supply 120 (the DC power supply 120 and the primary winding 10*a* are depicted schematically in FIG. 5). The DC power supply 120 should be capable of providing a DC current in the primary winding 10*a* greater the rated current of the primary winding 10*a*. Preferably, the DC power supply 120 is electrically coupled to a variable power regulator 121 to facilitate control of the current supplied to the electrical conductor 16 by the DC power supply 120. (The variable power regulator 121 may or may not be part of the DC power supply 120.)

The variable power regulator 121 should be adjusted so that a DC current greater than the rated current of the primary winding 10*a* initially flows through the electrical conductor 16. The resistance of the electrical conductor 16 to the flow of current therethrough causes the temperature of the electrical conductor 16 to rise within each individual layer thereof. The layers of the electrical conductor 16, in turn, heat the adjacent sheets of insulation 18 (including the adhesive 18*b*).

Preferably, the variable power regulator 121 is adjusted so that the DC current through the electrical conductor 16 is initially approximately three times to approximately five times the rated current of the primary winding 10*a*. Subjecting the electrical conductor 16 to a current of this magnitude is believed to be necessary to facilitate a relatively quick transition through the range of temperatures (approximately 60° C. to approximately 100° C.) at which the adhesive 18*b* begins to melt.

The desired curing temperature of the adhesive 18*b* is approximately 130° C.±approximately 15° C. The temperature of the primary winding 10*a* should be monitored, and the DC current through the primary winding 10*a* should be adjusted incrementally until the temperature of the primary winding 10*a* stabilizes within the desired range. More particularly, the DC current through the primary winding 10*a* should be maintained at its initial level until the temperature of the primary winding 10*a* is approximately equal to the target value of 130° C. The DC current can subsequently be decreased in increments of approximately 1° C. until the temperature of the primary winding 10*a* stabilizes within the desired range.

It should be noted that the melting and curing temperatures for the adhesive 18*b* are application-dependent and supplier-dependent, and specific values for these parameters are included for exemplary purposes only.

The temperature of the primary winding 10*a* should subsequently be monitored, and the variable power regulator 121 should be adjusted as necessary to maintain the temperature of the primary winding 10*a* within the range required to adequately cure the adhesive 18*b*.

The temperature of the primary winding 10*a* at a given point in time (Td) can be estimated based on the resistance (Rd) of the electrical conductor 16 at that time, as follows:

$$T_d(\text{in } ^\circ\text{ C.})=(R_d/R_o)\,(235+T_o)-235$$

where $T_o$ and $R_o$ are the initial temperature and resistance of the electrical conductor 16, respectively.

The resistance $R_d$ can be calculated by dividing the voltage across the electrical conductor 16 by the current therethrough. (A conventional voltmeter 122 and a conventional ammeter 124 capable of providing the noted voltage and current measurements are depicted schematically in FIG. 5).

The initial temperature $T_o$ of the electrical conductor 16 can be estimated based on the ambient temperature, or by measurements obtained using a conventional temperature-measurement device such as an RTD. The initial resistance $R_o$ of the electrical conductor can be calculated by dividing the initial voltage across the electrical conductor 16 by the initial current therethrough.

Maintaining the temperature of the primary winding 10*a* within the target range of approximately 130° C.±approximately 15° C. for a predetermined period after the adhesive 18*b* has melted causes the adhesive 18*b* to cure. (The predetermined period can be, for example, twenty to ninety minutes, depending on the size of the primary winding 10*a*.) The flow of current though the electrical conductor 16 can be interrupted upon reaching the end of the predetermined period, and the electrical conductor 16 can be disconnected from the DC power supply 120 and the variable power regulator 121.

The adhesive 18*b* can thus be melted and cured without placing the primary winding 10*a* in a hot-air convection oven. Hence, the time associated with transferring the primary winding 10*a* to and from the hot-air convection oven can be eliminated though the use of the preferred method.

Moreover, it is believed that the cycle time required to melt and cure the adhesive 18*b* is substantially lower when using the preferred method in lieu of a hot-air convection oven. In particular, using the electrical conductor 10 as a heat source, it is believed, heats the primary winding 10*a* more quickly, and in a more uniform manner than a hot-air convection oven. The temperature of the primary winding 10*a* can thus be stabilized at a desired value more quickly than is possible using a hot-air convection oven. Hence, substantial reductions the cycle time associated with the manufacture of the primary winding 10*a* can potentially be achieved through the use of the preferred method.

In addition, the more uniform heating achieved using the electrical conductor 16 as a heat source, it is believed, can result in stronger mechanical bonds between the sheets of insulation 18 and the adjacent layers of the electrical conductor 16. The improved bonding can be particularly significant in the innermost layers of the primary winding 10, which can be difficult to heat using a hot-air convection oven.

Moreover, it is believed that the energy required to heat the primary winding 10*a* by flowing electrical current through the electrical conductor 16 is substantially less than that required to heat the primary winding 10*a* using a hot-air convection oven. Hence, cost savings attributable to lower energy use can be potentially achieved through the use of the preferred method.

The adhesive 18*b* in the primary windings 10*b*, 10*c* and the secondary windings 11*a*, 11*b*, 11*c* can subsequently be melted and cured in the manner described above in relation to the primary winding 10*a*. Alternatively, the primary windings 10*a*, 10*b*, 10*c* and the secondary windings 11*a*, 11*b*, 11*c* can be electrically coupled to the DC power supply 120 and the variable power regulator 121 in series, and the adhesive 18*b* in each of the primary windings 10*a*, 10*b*, 10*c* and the secondary windings 11*a*, 11*b*, 11*c* can be melted and cured on a substantially simultaneous basis.

It is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of the parts, within the principles of the invention.

For example, although the use of direct current to heat the primary winding 10*a* is preferred, alternating current can be used in the alternative. Alternating current, if used, should be of relatively low frequency, or should be used in combination with direct current to facilitate calculation of the temperature of the electrical conductor 16 in the above-described manner.

What is claimed is:

1. A method for manufacturing a transformer winding, comprising:

providing a power source;

winding an electrical conductor into a first plurality of turns;

placing an electrically insulating material having adhesive thereon over the first plurality of turns;

winding the electrical conductor into a second plurality of turns over the electrically insulating material;

connecting the power source to the electrical conductor; and curing the adhesive by providing electric power from the power source to the electrical conductor so as to heat the adhesive; wherein the curing of the adhesive by energizing the electrical conductor so that a current greater than a rated current of the transformer winding flows through the electrical conductor.

2. The method of claim 1, wherein the adhesive is a "B" stage epoxy adhesive.

3. The method of claim 1, wherein the power source is a direct-current power source.

4. The method of claim 1, further comprising providing a variable power regulator, and wherein the step of connecting the power source to the electrical conductor comprises electrically coupling the variable power regulator to the power source and the electrical conductor, and wherein the step of curing the adhesive comprises adjusting the power regulator to provide a current greater than a rated current of the transformer winding using the voltage regulator.

5. The method of claim 1, wherein the step of curing the adhesive is performed such that a direct current greater than the rated current of the transformer winding flows through the electrical conductor.

6. The method of claim 5, wherein the step of curing the adhesive is performed such that the direct current flowing through the electrical conductor has an initial value that is about three times to approximately five times the rated current of the transformer winding.

7. The method of claim 6, further comprising incrementally reducing the direct current from the initial value until a temperature of the electrical conductor stabilizes within a predetermined range.

8. The method of claim 7, wherein incrementally reducing the direct current comprises reducing the direct current in increments of approximately 1° C.

9. The method of claim 5, further comprising adjusting the direct current so that a temperature of the electrical conductor remains within a predetermined range.

10. The method of claim 9, wherein the step of adjusting the direct current is performed such that the temperature of the electrical conductor remains within the predetermined range for a predetermined period.

11. The method of claim 10, wherein the predetermined period is approximately twenty to approximately ninety minutes.

12. The method of claim 9, wherein the predetermined range is approximately 130° C.±approximately 15° C.

13. The method of claim 1, further comprising forming a second transformer winding with a second electrical conductor, connecting the second electrical conductor of the second transformer winding to the power source, and providing electric power from the power source to the second electrical conductor at the same time as the electrical conductor.

14. The method of claim 1, further comprising providing a voltmeter and an ammeter, electrically coupling the voltmeter and the ammeter to the electrical conductor, and measuring a voltage across the electrical conductor and a current flowing through the electrical conductor using the voltmeter and the ammeter.

15. The method of claim 14, further comprising calculating a temperature of the electrical conductor at a given time based on a resistance of the electrical conductor at the given time, an initial resistance of the electrical conductor, and an initial temperature of the electrical conductor.

16. The method of claim 15, further comprising calculating the resistance of the electrical conductor at the given time based on a voltage across the electrical conductor at the given time and the current flowing through the electrical conductor at the given time.

17. The method of claim 1, wherein the electrically-insulating material is heat-curable epoxy diamond pattern coated kraft paper.

18. The method of claim 1, wherein winding an electrical conductor into a first plurality of turns comprises winding the electrical conductor around a winding leg of a core of a transformer.

* * * * *